US007347586B2

(12) United States Patent
Izardel

(10) Patent No.: US 7,347,586 B2
(45) Date of Patent: Mar. 25, 2008

(54) LED LIGHT BULB

(75) Inventor: Lazar Izardel, Tel Aviv (IL)

(73) Assignee: Gamasonic Ltd., Tel Aviv (IL)

( * ) Notice: Subject to any disclaimer, the term of this patent is extended or adjusted under 35 U.S.C. 154(b) by 87 days.

(21) Appl. No.: 11/124,074

(22) Filed: May 9, 2005

(65) Prior Publication Data

US 2006/0250792 A1 Nov. 9, 2006

(51) Int. Cl.
*F21V 21/00* (2006.01)

(52) U.S. Cl. ..... 362/247; 362/800; 362/249; 362/650; 362/235

(58) Field of Classification Search ..... 362/800, 362/650, 545, 235, 247, 249, 252; 340/815.45
See application file for complete search history.

(56) References Cited

U.S. PATENT DOCUMENTS 4,965,488 A * 10/1990 Hihi ..... 313/499
5,707,139 A * 1/1998 Haitz ..... 362/231
5,929,788 A * 7/1999 Vukosic ..... 340/908.1
6,149,283 A * 11/2000 Conway et al. ..... 362/236
6,183,100 B1 * 2/2001 Suckow et al. ..... 362/35
6,464,373 B1 * 10/2002 Petrick ..... 362/235
7,011,430 B2 * 3/2006 Chen ..... 362/235

* cited by examiner

*Primary Examiner*—Anabel Ton
(74) *Attorney, Agent, or Firm*—Dekel Patent Ltd.; David Klein

(57) ABSTRACT

A light emitting diode (LED) light bulb including at least one LED mounted in a light bulb in electrical communication with an electrical contact adapted for connection to an electrical power source, and a refractor/reflector positioned in the light bulb to reflect outwards light rays emanating from the at least one LED, the refractor/reflector including a curved surface concavely curved with respect to the at least one LED.

8 Claims, 1 Drawing Sheet

LED LIGHT BULB

FIELD OF THE INVENTION

The present invention relates generally to LED (light emitting diode) light bulbs, and more specifically to an LED light bulb that includes a reflector, which reflects light outwards from LEDs mounted in the light bulb.

BACKGROUND OF THE INVENTION

As is well known in the art, different kinds of light bulbs have been developed in addition to the familiar incandescent light bulb, such as halogen lights, florescent lights and LED (light emitting diode) lights. Halogen lights have some disadvantages, such as high temperatures and relatively high wattage.

LED light bulbs have several advantages. For example, white LEDs have been developed that will last up to 50,000 hours, about 50 times as long as a 60-watt bulb. LED light bulbs are advantageous in places where changing bulbs is difficult or expensive (e.g., hard to reach places, such as the exterior of buildings). Hotels may use LEDs to save costs of replacing burned-out incandescent bulbs.

Although a LED requires minute amounts of electricity, generates little heat, and transmits a focused beam of light, there is a recognized problem of gathering enough light so that the LED light can compete with an incandescent, halogen or even a florescent light.

The prior art has recognized the need for focusing light from LEDs to solve the above problem. For example, some LED light bulbs place the LED in a cup shaped mirrored cavity to focus and intensify the light. U.S. Pat. No. 6,840,654 to Guerrieri, et al. describes an LED light bulb with a conical reflecting chamber and a rear housing to accommodate a series of light emitting diodes, each diode residing in a chamber adapted therefore.

U.S. Pat. No. 6,361,190 to McDermott describes a large surface LED lighting device using a single reflecting means to increase the divergence of light.

PCT published patent application WO 02/14738A1 to Ming describes a combination of a reflector and magnifying lens to increase the brightness and utility of an LED light.

US Patent Application US2002/0080622 to Pashley et al describes a multifaceted cup assembly to increase the divergence and intensity of an LED light.

SUMMARY OF THE INVENTION

The present invention seeks to provide a novel LED light bulb, as is described more in detail hereinbelow.

There is thus provided in accordance with an embodiment of the present invention a light emitting diode (LED) light bulb including at least one LED mounted in a light bulb in electrical communication with an electrical contact adapted for connection to an electrical power source, and a refractor/reflector positioned in the light bulb to reflect outwards light rays emanating from the at least one LED, the refractor/reflector including a curved surface concavely curved with respect to the at least one LED. The curved surface of the refractor/reflector may have a parabolic curve.

In accordance with an embodiment of the present invention the refractor/reflector may have a narrow end and a wide end, the curved surface curving outwards towards the wide end. A plurality of LEDs may be mounted about the narrow end of the refractor/reflector, wherein light emanating from the LEDs is directed onto the curved surface and reflected outwards from the light bulb. Optionally, one or more LEDs may be mounted in the wide end of the refractor/reflector and in electrical communication with an electrical contact adapted for connection to an electrical power source.

BRIEF DESCRIPTION OF THE DRAWINGS

The present invention will be understood and appreciated more fully from the following detailed description taken in conjunction with the drawing in which.

DETAILED DESCRIPTION OF EMBODIMENTS

Figure 1:
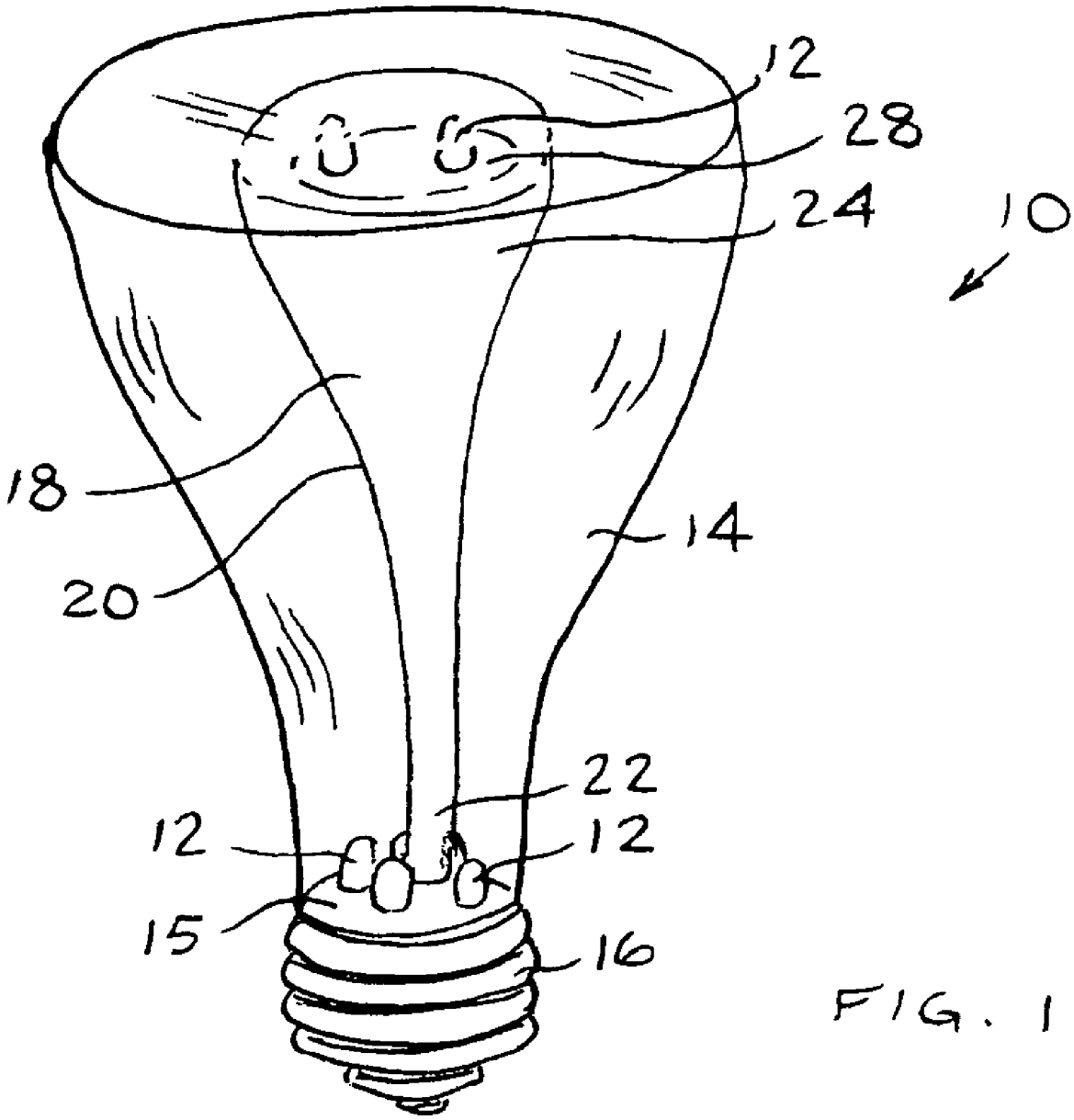
FIG. 1 is a simplified pictorial illustration of an LED light bulb, constructed and operative in accordance with an embodiment of the present invention.

Reference is now made to FIG. 1, which illustrates an LED light bulb 10, constructed and operative in accordance with an embodiment of the present invention.

The LED light bulb may include one or more LEDs 12 mounted in a light bulb 14 in electrical communication with an electrical contact 16 adapted for connection to an electrical power source (such as mains, not shown). The LED light bulb 10 may be DC powered (e.g., from a battery, 6-12V) or AC powered (e.g., 110-120 or 220-240 VAC) or solar powered (e.g., connected to a solar cell).

In a preferred embodiment, the LEDs 12 are mounted on a printed circuit board 15 electrically connected to electrical contact 16. In the non-limiting illustrated embodiment, electrical contact 16 is a standard screw base contact. However, the invention is not limited to this type of contact, and LED light bulb 10 may have any other suitable contact, such as but not limited to, a single pin bayonet base, a double pin bayonet base (with one negative and one positive terminal in the base to match two contact points in a corresponding socket), a flange base, an MR16 socket base, or a wired connection.

A refractor/reflector 18 may be positioned in the light bulb 14 to reflect outwards light rays emanating from the LEDs 12. The refractor/reflector 18 has a curved surface 20 concavely curved with respect to the LEDs 12. The curved surface 20 may be white, for example. "White" is defined as the color that has no or little hue, due to the reflection of all or almost all incident light. "White" in the specification and claims encompasses, bright white, "dirty" white, off-white, gray-white, snow white, hard-boiled-egg white and other shades of white. Alternatively, the curved surface 20 may be silvered or have a mirror finish (mirrored). The curved surface 20 of the refractor/reflector 18 may be, without limitation, a parabolic curve or a tulip-shaped curve, for example. The periphery of the curved surface 20 about its longitudinal axis may be smooth and round (e.g., conical). Alternatively, the curved surface 20 may be prismatic, that is, have facets about its longitudinal axis.

In the non-limiting illustrated embodiment, the refractor/reflector 18 has a narrow end 22 and a wide end 24. The curved surface 20 curves outwards towards the wide end 24. A plurality of LEDs 12 are mounted about the narrow end 22 of the refractor/reflector 18, wherein light emanating from the LEDs 12 is directed onto the curved surface 20 and reflected outwards (e.g., horizontally, omnidirectionally 360°) from the light bulb 14.

The refractor/reflector 18 is shown with the wide end 24 facing upwards to the top part of the light bulb 14 (opposite electrical contact 16), but the invention also encompasses the opposite, wherein the curved surface 20 faces downwards or anything in-between.

Optionally, one or more LEDs 12 may be mounted in the wide end 24 of the refractor/reflector 18. These LEDs 12 may be in electrical communication with an electrical contact (e.g., the same electrical contact 16 or a different one), such as being mounted on a PCB 28 or similar substrate which is wired to the electrical contact 16.

The LEDs 12 may be arranged in any pattern, such as but not limited to, a circular pattern or matrix pattern. The LEDs 12 may be of any size, mcd rating, and color (e.g., white, red, green, blue, yellow or other non-white colors, or a RGB (red, green, blue) changing LED, or any combination thereof). Light bulb 14 may be transparent or translucent (or anything between), and may have any size, shape and color.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A light emitting diode (LED) light bulb comprising:

a plurality of LEDs mounted on a LED mounting surface in a light bulb, said LEDs being in electrical communication with an electrical contact adapted for connection to an electrical power source; and a refractor/reflector comprising a narrow end and a wide end, the narrow end being reflective and mounted in and extending to said LED mounting surface such that said LEDs are positioned peripherally around and outside the narrow end of said refractor/reflector, wherein the narrow end of said refractor/reflector is centrally positioned with respect to said LEDS, said LEDs being adapted to emanate light rays, in a direction away from and opposite to said electrical contact, towards a curved surface of said refractor/reflector, wherein the curved surface of said refractor/reflector is adapted to reflect outwards the light rays emanating from said LEDs, wherein the curved surface is concavely curved with respect to said LEDs and curved outwards from the narrow end towards said wide end, and at least one LED mounted in the wide end of the refractor/reflector and in electrical communication with said electrical contact.

2. The LED light bulb according to claim 1, wherein the curved surface of said refractor/reflector has a parabolic curve.

3. The LED light bulb according to claim 1, wherein said curved surface is white.

4. The LED light bulb according to claim 1, wherein said curved surface is minored.

5. The LED light bulb according to claim 1, wherein at least one of said LEDs comprises a white LED.

6. The LED light bulb according to claim 1, wherein at least one of said LEDs comprises a non-white LED.

7. The LED light bulb according to claim 1, wherein at least one of said LEDs comprises a RGB (red, green, blue) changing LED.

8. The LED light bulb according to claim 1, wherein said at least one LED mounted in the wide end of the refractor/reflector is mounted on a substrate which is wired to said electrical contact.

* * * * *